United States Patent [19]

Helvy et al.

[11] Patent Number: 4,680,504

[45] Date of Patent: Jul. 14, 1987

[54] ELECTRON DISCHARGE DEVICE HAVING A NARROW RANGE SPECTRAL RESPONSE

[75] Inventors: Fred A. Helvy, Manheim Township, Lancaster County; Arthur F. McDonie, East Hempfield Township, Lancaster County, both of Pa.

[73] Assignee: RCA Corporation, Princeton, N.J.

[21] Appl. No.: 786,530

[22] Filed: Oct. 11, 1985

[51] Int. Cl.[4] ..... H01J 40/02; H01J 43/28

[52] U.S. Cl. ..... 313/524; 313/539; 313/541; 313/112

[58] Field of Search ..... 313/110, 112, 523, 524, 313/539, 541; 350/1.1, 375, 311

[56] References Cited

U.S. PATENT DOCUMENTS

| | | | |
|---|---|---|---|
| Re. 30,249 | 4/1980 | Faulkner | 313/104 |
| 2,470,666 | 5/1949 | Suffield | 250/164 |
| 2,655,452 | 10/1953 | Barnes et al. | 106/52 |
| 2,676,282 | 4/1954 | Polkosky | 313/102 |
| 3,143,683 | 8/1964 | Duncan et al. | 313/110 |
| 3,247,413 | 4/1966 | Bisso et al. | 313/524 X |
| 3,753,023 | 8/1973 | Sommer | 313/103 |
| 3,793,552 | 2/1974 | Glascock, Jr. et al. | 313/539 |
| 4,196,257 | 4/1980 | Engstrom et al. | 428/457 |
| 4,306,188 | 12/1981 | Ibaugh | 324/409 |
| 4,405,881 | 9/1983 | Kobayashi | 313/480 |

OTHER PUBLICATIONS

*RCA Electro-Optics Handbook*, pp. 13 and 14 (1974).

*Handbook of Optics*, W. G. Driscoll, Editor, McGraw-Hill, pp. 7-24 (1978).

*Product Bulletin* 150*X*8*S*, EIMAC, San Carlos, CA, FIG. 5, (1011968).

*Primary Examiner*—Leo H. Boudreau

*Assistant Examiner*—K. Wieder

*Attorney, Agent, or Firm*—Eugene M. Whitacre; Dennis H. Irlbeck; Vincent J. Coughlin, Jr.

[57] ABSTRACT

A so-called "solar-blind" photomultiplier tube includes an envelope having a sidewall and an input faceplate formed from an ultraviolet transmitting filter. A photoemissive cathode is disposed within the envelope for providing photoelectrons in response to radiation incident thereon. The cathode has an intrinsic responsivity extending from the near-ultraviolet portion through the visible portion of the electromagnetic spectrum; however, the filter faceplate transmits only the ultraviolet portion of the spectrum to the photoemissive cathode. The combination of the filter faceplate and the photoemissive cathode therefore limits the tube to a responsivity within the wavelength range of about 300 to less than 400 nanometers.

2 Claims, 5 Drawing Figures

ELECTRON DISCHARGE DEVICE HAVING A NARROW RANGE SPECTRAL RESPONSE

BACKGROUND OF THE INVENTION

The present invention relates to a photomultiplier tube having a narrow band spectral response and particularly to a photomultiplier tube having an ultraviolet spectral response (responsivity) within the wavelength range of about 300 to less than 400 nanometers (nm). This type of tube is known as a "solar blind" tube because of its sensitivity in the ultraviolet portion and insensitivity to the visible portion of the electromagnetic spectrum.

U.S. Pat. No. 4,196,257, issued to Engstrom et al. on Apr. 1, 1980, discloses a bi-alkali telluride photocathode for a "solar blind" photomultiplier tube which has high responsivity at wavelengths shorter than 290 nm. However, the responsivity of the bi-alkali telluride photoemissive cathode within the wavelength range of 300 to 400 nm is less than 1 milliampere per watt (mA/w). The bi-alkali telluride photocathode is formed on the interior surface of a transparent glass faceplate which transmits light in the ultraviolet, visible and near infrared portions of the electromagnetic spectrum.

It is known in the art that photomultiplier tubes having conventional alkali and bi-alkali antimonide photoemissive cathodes formed on transparent faceplates, such as ultraviolet grade sapphire or 9741 glass, or the equivalent, intrinsically have high responsivity in the near ultraviolet and visible portions of the electromagnetic spectrum. A typical spectral response curve for a potassium-cesium-antimonide photoemissive cathode formed on the transparent glass faceplate, which transmits in the ultraviolet as well as the visible portion of the spectrum, is shown in FIG. 1. One technique, known in the art, for limiting the repsonsivity of such tubes to the ultraviolet portion of the spectrum is to interpose an ultraviolet transmitting filter between the radiation source and the faceplate of the tube. The ultraviolet transmitting filter transmits predominantly the ultraviolet portion of the spectrum and substantially blocks the visible portion of the spectrum, thereby creating a "solar blind" tube from a conventional photomultiplier tube. The drawback of such a tube and filter combination is that multiple reflections occur from the surfaces of the filter and the tube. As shown in FIG. 2, the incident radiation, represented by incident ray I, is reflected from the front and back surfaces of the ultraviolet filter and also from the front and back surfaces of the tube faceplate before impinging on the photoemissive cathode formed on the interior surface of the tube faceplate. The four reflections, $r_1$, $r_2$, $r_3$ and $r_4$, significantly reduce the radiation transmitted to the photoemissive cathode and, therefore, reduce the radiation available to the photoemissive cathode for producing photoelectrons. Additionally, means must be provided to position the filter between the radiation source and the faceplate and to prevent stray radiation from impinging on the tube faceplate. Cementing the filter to the faceplate is generally avoided, because the adhesive further attenuates the ultraviolet radiation into the faceplate by absorption in the adhesive. Mechanical structures for attaching the filter between the tube and the radiation source and for preventing light-leaks therebetween are costly.

A filter and tube combination, for use with a television picture tube, is disclosed in U.S. Pat. No. 3,143,683, issued to Duncan et al. on Aug. 4, 1964. The filter is generally described, in one embodiment, as comprising an implosion plate or window which is either spaced from or laminated to the faceplate of the television tube. The patent also discloses, in another embodiment, that the filter may comprise the faceplate of the television tube. The purpose of the filter, in both embodiments, is to help equalize the intensity of the phosphor colors and to absorb ambient light at about 580 nm, the portion of the spectrum near where the eye is most sensitive. The ambient light, if reflected to the viewer, cuts down on color definition and contrast. However, uniform absorption throughout the visible spectrum is not beneficial in this application since this would also absorb the blue-, green- and red-emitted phosphor colors. Since it is known that the phosphor elements emit very little light in the portions of the visible spectrum between the colors, the filter is designed to selectively absorb at 580 nm where the deleterious effect of the ambient light can be reduced without decreasing the brightness of the television picture. The patent discloses that at the wavelength of greatest absorption (580 nm), the filter still transmits 45.2% of the radiant energy. At wavelengths on either side of 580 nm, the radiant energy transmittance of the filter increases to enhance the transmission of the blue, green and red light from the phosphor elements.

The fact that the Duncan et al. patent utilizes a filter faceplate for a television picture tube to enhance color transmission through the faceplate and to selectively absorb ambient light that would otherwise be reflected to the viewer and would reduce color definition and contrast does not suggest the use of a filter faceplate for a "solar blind" photomultiplier tube. Such a "solar blind" photomultiplier tube requires a filter which blocks the entire visible spectrum and passes only the ultraviolet spectrum. However, such a filter poses problems unique to photomultiplier tubes in that visible light is used during the formation of the photoemissive cathode. U.S. Pat. No. 2,676,282, issued to Polkosky on Apr. 20, 1954, discloses a method of depositing a conductive metal film on the interior surface of a faceplate by monitoring the transmission of light through the film. The use of an incandescent tungsten light source for monitoring photocurrent during the formation of a photoemissive cathode is described in U.S. Pat. No. 4,306,188, issued to Ibaugh on Dec. 15, 1981. The methods described in the Polkosky and Ibaugh patents would seem to be negated if a filter, which blocks the visible spectrum, were used as a faceplate for a photomultiplier tube.

Accordingly, the need exists for a cost effective way of producing a "solar blind" photomultiplier tube having high responsivity in the wavelength range of about 300 to less than 400 nm.

SUMMARY OF THE INVENTION

An electron discharge device includes an envelope having a sidewall and an input faceplate. A photoemissive cathode is disposed within the envelope for providing photoelectrons in response to radiation incident thereon. The device is improved by forming the faceplate from an optical filter which transmits radiation predominantly in a first portion of the electromagnetic spectrum. Furthermore, the photoemissive cathode has an intrinsic responsivity extending from said first through a second portion of the spectrum. However, the combination of the filter faceplate and the photoemissive cathode limits the tube to a responsivity within a spectral range of said first portion of the electromagnetic spectrum.

DETAILED DESCRIPTION OF THE PREFERRED EMBODIMENT

Figure 3:
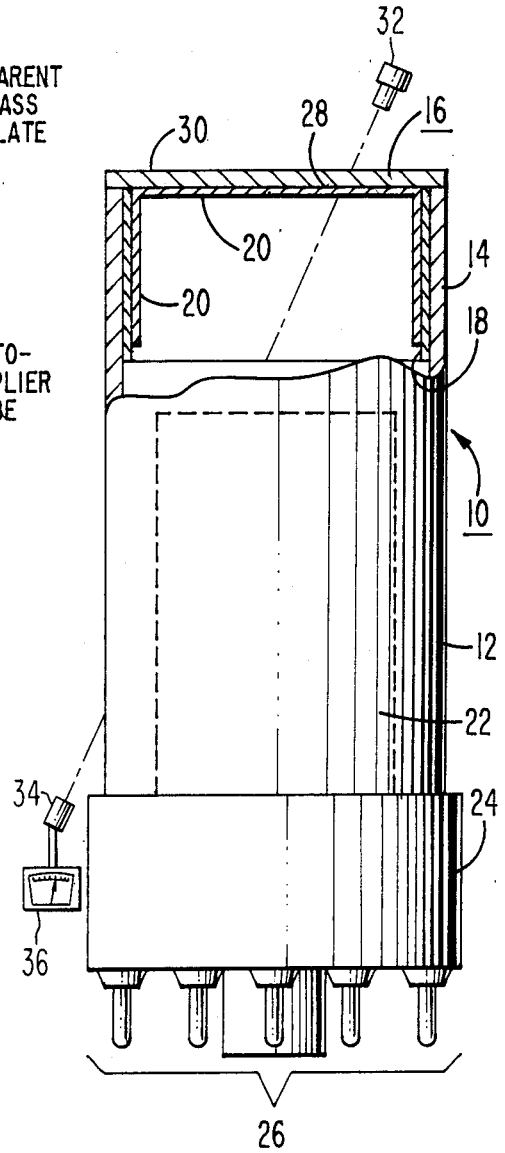
FIG. 3 is a partially broken-away axial view of a novel photomultiplier tube incorporating a filter faceplate with a potassium-cesium-antimonide photoemissive cathode formed thereon.

With reference to FIG. 3, a novel "solar blind" photomultiplier tube 10 comprises an evacuated envelope 12 having a sidewall 14 which is closed at one end by a faceplate 16 comprising an ultraviolet transmitting filter described hereinafter. The sidewall 14 is closed at the other end by a stem portion (not shown). A conductive layer 18, such as aluminum, is vapor deposited on a portion of the sidewall 14 adjacent to the faceplate 16. A photoemissive cathode 20 is formed on the interior surface of the faceplate 16 and also along a portion of the conductive layer 18 on the sidewall 14. The conductive layer 18 provides an electrical contact to the photoemissive cathode 20. The photoemissive cathode 20 may comprise any of the materials known in the art having responsivity in the ultraviolet portion of the spectrum, specifically between 300 and 400 nanometers (nm), although a potassium-cesium-antimonide photoemissive cathode is preferred for its ease of manufacturability, its intrinsic high responsivity in the near-ultraviolet and visible portions of the electromagnetic spectrum, and its low noise. The cathode 20 emits or provides photoelectrons in response to radiation incident thereon. The tube 10 further includes an electron multiplier cage assembly 22, shown schematically by the dashed lines of FIG. 3. The cage assembly 22 is conventional and may, for example, comprise a primary dynode (not shown), such as that disclosed in U.S. Pat. No. Re 30,249, issued to R. D. Faulkner on Apr. 1, 1980, and a plurality of box-and-grid secondary dynodes and an anode (also not shown), such as those described in copending U.S. patent application Ser. No. 611,753, filed on May 18, 1984, by McDonie et al. The Faulkner patent and the McDonie et al. patent application are incorporated by reference herein for the purpose of disclosure. While the above dynode configuration is preferred, any other dynode configuration, such as in-line, circular-cage or venetian-blind, may be used. A base 24 having a plurality of pins 26, extending therethrough, is affixed to the stem end of the tube to provide electrical connection to the tube elements, including the photoemissive cathode 20 and the dynodes and anode of the cage assembly 22.

Figure 1:
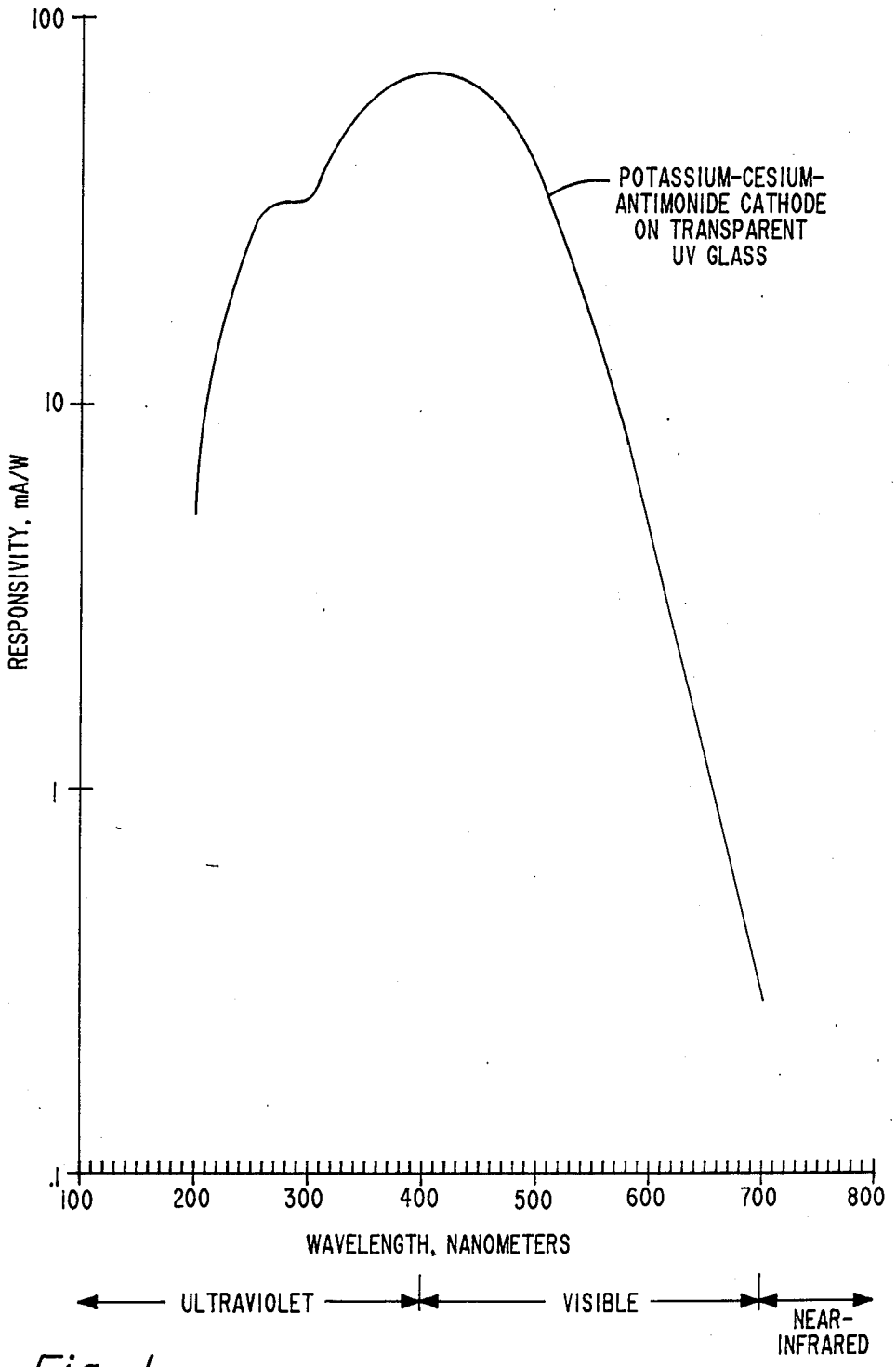
FIG. 1 is a graph of the spectral response of a typical potassium-cesium-antimonide photoemissive cathode formed on a transparent ultraviolet transmitting glass faceplate.
Figure 4:
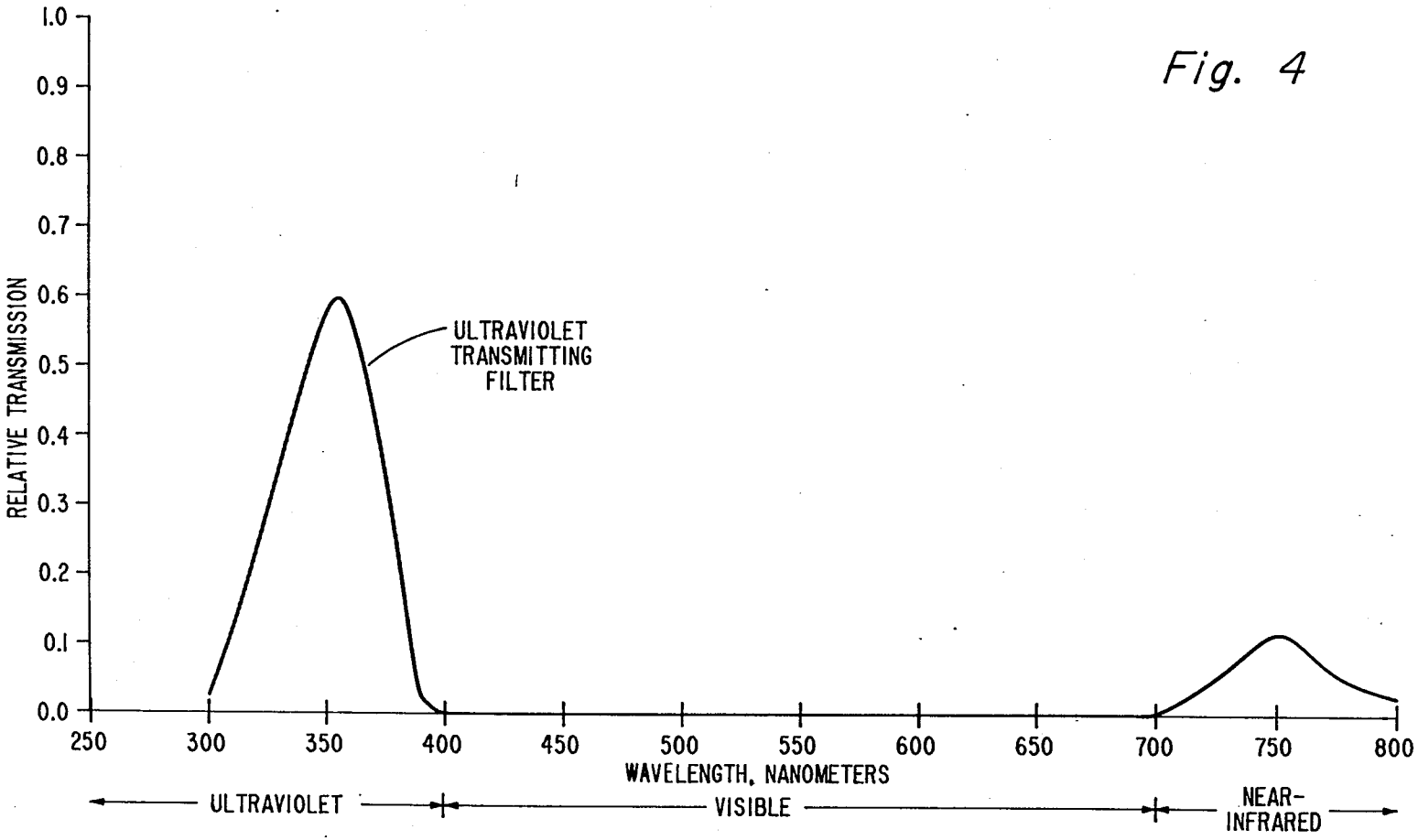
FIG. 4 is a graph of the relative transmission of the optical filter faceplate used in the tube of FIG. 3.

The faceplate 16 comprises a ultraviolet transmitting optical filter of plano-plano construction having an interior surface 28 and an exterior surface 30. The periphery of the interior surface 28 is sealed to one end of the sidewall 14. The filter faceplate 16 is preferably formed of UG1 type glass, or its equivalent, which is available from Schott Glass Technologies, Inc. Duryea, Pa. As shown in FIG. 4, the UG1 optical filter faceplate transmits radiation predominantly in the near-ultraviolet portion of the electromagnetic spectrum, with a peak transmission at about 360 nm and a range extending from about 300 to 400 nm. The transmission of the filter faceplate 16 within the visible portion of the spectrum, ranging from about 400 nm to 700 nm, is essentially zero. The filter faceplate 16 has a secondary transmission peak which occurs at about 745 nm; however, this poses no problem as explained hereinafter. When the potassium-cesium-antimonide photoemissive cathode 20 is formed on the interior surface 28 of the filter faceplate 16, radiation passes through faceplate 16 into the photoemissive cathode 20 in the near-infrared portion of the electromagnetic spectrum in the vicinity of the secondary transmission peak at 745 nm; however, as shown in FIG. 1, the responsivity of the potassium-cesium-antimonide photoemissive cathode 20 is insignificant beyone 700 nm, and no photoemission occurs in the near-infrared portion of the spectrum. Since the filter faceplate 16 does not transmit radiation in the visible portion of the spectrum, no radiation in the wavelength range of 400 nm to 700 nm enters the photoemissive cathode 20, and no photoemission occurs throughout this portion of the spectrum. The tube 10 is therefore "solar blind" and responds only to radiation in the near ultraviolet portion of the electromagnetic spectrum.

In order to form the potassium-cesium-antimonide photoemissive cathode 20 through the ultraviolet transmitting faceplate 16, a light source 32 is positioned above the faceplate 16. The tube is connected to an exhaust system (not shown) and baked to remove occluded gases in the manner described in U.S. Pat. No. 3,753,023, issued to Sommer on Aug. 14, 1973, and incorporated by reference herein for the purpose of disclosure. The light source 32 predominantly emits visible light; however, the light also has a near-ultraviolet component. The light is directed at the faceplate 16, and the ultraviolet component is transmitted through the faceplate 16 and sidewall 14 of the envelope 12 onto a detector 34 which has a spectral response which includes responsivity in the near-ultraviolet portion of the spectrum. The detector 34 is connected to an amplifying device 36 having a graduated dial indicating a current flow proportional to the amount of ultraviolet radiation from source 32. The detector 34 and method of use are disclosed in the above-referenced U.S. Pat. No. 2,676,282 and is incorporated by reference herein for the purpose of disclosure. The device 36 can be adjusted to show a dial reading of 100 at full transmission of the light through the envelope 12. Manganese is evaporated from a manganese source (not shown) within the tube 10 and deposited as a thin layer onto the interior surface 28 of the faceplate 16 until the transmission from the source 32 through the envelope 12 has been reduced to about 92% transmission. The tube is preferably at room temperature during the manganese evaporation step. The manganese is then oxidized, as described in U.S. Pat. No. 2,676,282, to form a manganese-oxide substrate. The potassium-cesium-antimonide photocathode may be formed on the manganese-oxide substrate in the manner described in the above-referenced U.S. Pat. No. 3,753,023, or by alternative methods. One alternative method that is expeditious includes the steps of evaporating a quantity of potassium metal from a potassium source (not shown) within the tube and depositing a potassium layer onto the manganese-oxide substrate. Preferably, the temperature of the tube during the potassium evaporation step is about 100° C. The evaporation is continued until the potassium source is exhausted. Then, at a tube temperature of 100° C., antimony is evaporated from an antimony source (not shown) within the tube to form an antimony layer on the previously deposited potassium layer in the manner similar to that described in U.S. Pat. No. 4,357,368, issued to Longsderff et al. on Nov. 2, 1982, and incorporated by reference herein for the purpose of disclosure. The antimony layer is baked at a temperature of about 125° C. for about 10 minutes. Finally, a quantity of cesium metal is evaporated from a cesium source (not shown) within the tube and deposited as a layer on the previously deposited antimony and potassium layers. The evaporation from the cesium source is continued until the cesium source is exhausted. The tube is baked at a temperature of about 165° C. for about 35 minutes during the cesium evaporation step. The tube is then cooled to room temperature and removed from the exhaust system.

Figure 5:
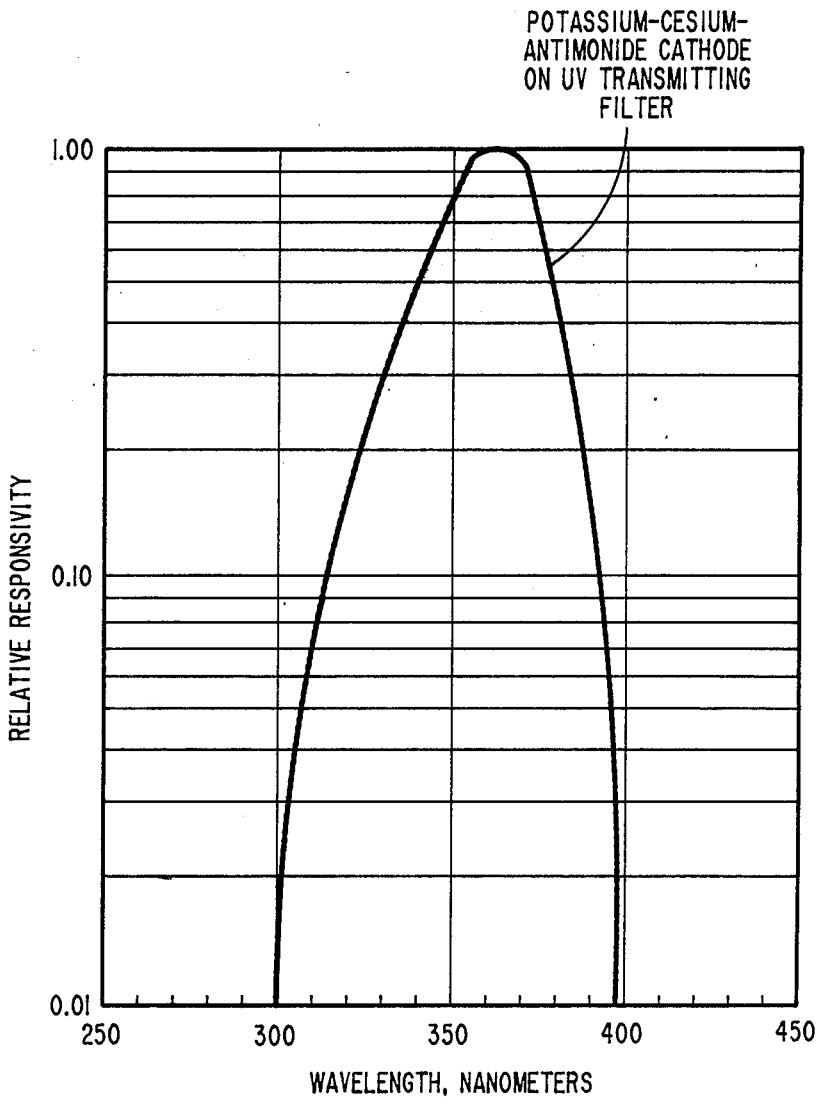
FIG. 5 is a graph of the relative responsivity of the tube of FIG. 3.

FIG. 5 shows a graph of the relative responsivity of the filter faceplate 16 and the photoemissive cathode 20 combination of the tube 10 made according to the latter described cathode formation process. The filter faceplate 16 limits the responsivity of the cathode 20 to the wavelength range of about 300 to less than 400 nm. The peak responsivity of the photoemissive cathode 20 occurs at the peak transmitting wavelength (about 360 nm) of the filter faceplate 16. A typical absolute value of the responsivity of the cathode 20 measured through the ultraviolet transmitting filter faceplate 16 is 64 mA/w at 360 nm. The absolute values of responsivity at other points on the curve of FIG. 5 between about 300 to about 398 nm can be determined by multiplying the relative responsivity at the wavelength of interest by the maximum responsivity of 64 mA/w.

Figure 2:
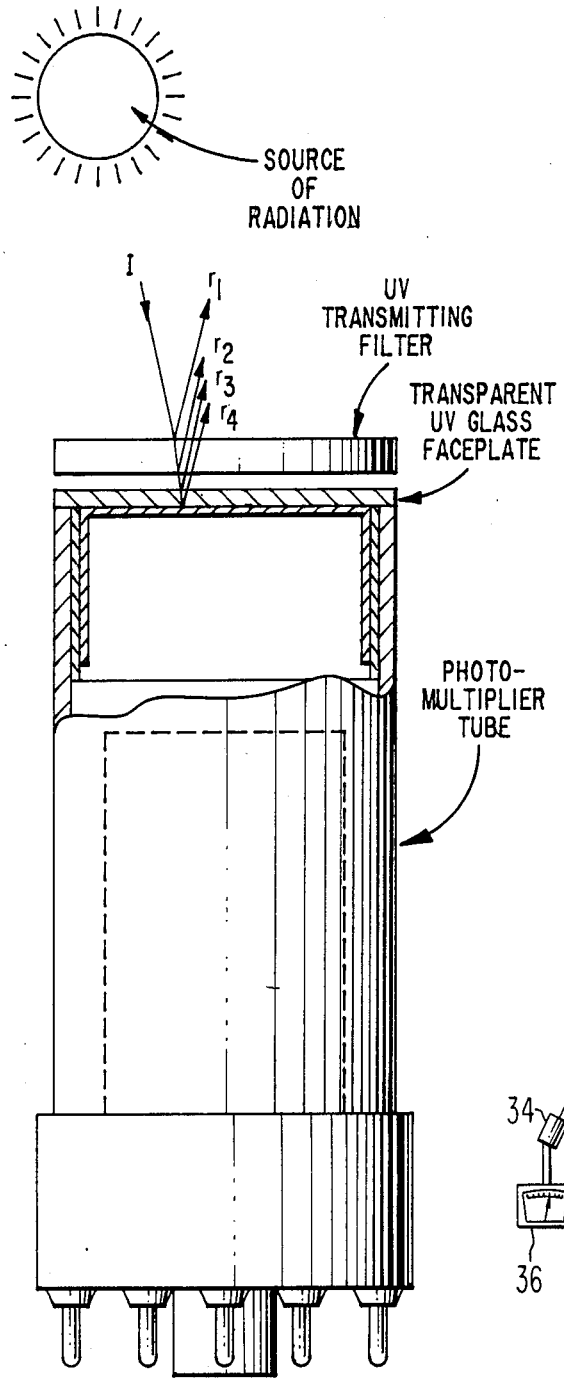
Fig. 2 PRIOR ART
FIG. 2 shows a prior art tube and filter system for sensing ultraviolet radiation.

The present novel tube structure is superior to the prior art structure of FIG. 2 in that the present tube 10, having the ultraviolet transmitting filter faceplate 16 integral with the envelope 12, eliminates two of the reflective surfaces for incident radiation shown in FIG. 2. Additionally, since the ultraviolet transmitting filter forms the faceplate 16 of the envelope 12, the need for costly attachment and light shielding structures to secure the filter to the tube are eliminated.

What is claimed is:

1. In an electron discharge device having an envelope including a sidewall and an input faceplate, and a photoemissive cathode within said envelope for providing photoelectrons in response to radiation incident thereon, the improvement comprising said input faceplate being an ultraviolet transmitting filter which transmits radiation predominantly in the ultraviolet portion of the electromagnetic spectrum but transmits essentially no radiation in the visible portion of the electromagnetic spectrum, and said photoemissive cathode having an intrinsic responsivity extending from the near-ultraviolet portion through the visible portion of the electromagnetic spectrum, the combination of said filter faceplate and said photoemissive cathode limiting said device to a responsivity within the wavelength range of about 300 to less than 400 nanometers.

2. In a "solar blind" photomultiplier tube having an evacuated envelope including a sidewall and an input faceplate, said faceplate having an exterior surface and an interior surface, a photoemissive cathode on the interior surface of said faceplate for providing photoelectrons in response to radiation incident thereon, and electron multiplying means spaced from said cathode, the improvement comprising said input faceplate comprising an ultraviolet transmitting filter which transmits radiation predominantly in the near-ultraviolet portion of the electromagnetic spectrum but transmits essentially no radiation in the visible portion of the electromagnetic spectrum, and said photoemissive cathode having an intrinsic responsivity extending from the near-ultraviolet portion through the visible portion of the electromagnetic spectrum, the combination of said filter faceplate and said photoemissive cathode limiting said tube to a responsivity within the wavelength range of about 300 to less than 400 nanometers.

* * * * *